United States Patent [19]

Bishop et al.

[11] 3,961,892

[45] June 8, 1976

[54] TEXTILE SOFTENING AGENTS

[75] Inventors: David Paul Bishop; Ronald Meredith Morris, both of Wirral, England

[73] Assignee: Lever Brothers Company, New York, N.Y.

[22] Filed: Feb. 28, 1974

[21] Appl. No.: 446,981

Related U.S. Application Data

[62] Division of Ser. No. 233,343, March 9, 1972, Pat. No. 3,847,915.

[30] Foreign Application Priority Data

Mar. 18, 1971 United Kingdom ..... 7179/71

[52] U.S. Cl. ..... 8/190; 8/129

[51] Int. Cl.[2] ..... D06M 13/18; D06M 13/34

[58] Field of Search ..... 8/190, 129

[56] References Cited

UNITED STATES PATENTS

| | | | |
|---|---|---|---|
| 2,202,828 | 6/1940 | Bruson | 260/249.8 |
| 3,454,551 | 7/1969 | Mangini et al. | 260/248 X |
| 3,651,056 | 3/1972 | Maruyama et al. | 260/249.8 |

FOREIGN PATENTS OR APPLICATIONS

| | | |
|---|---|---|
| 1,085,492 | 1/1958 | Germany |
| 1,077,885 | 8/1967 | United Kingdom |

*Primary Examiner*—Murray Tillman
*Assistant Examiner*—A. H. Koeckert

[57] ABSTRACT

This invention relates to compositions comprising a class of new chemical compounds which can be applied to a textile material preferably composed of fibers of cellulose, regenerated cellulose or a cellulose ester or ether, to contribute an attractive softening effect. The new compounds possess a hydrophilic solubilising group linked to each of two triazine rings and an average of two hydrophobic groups and two halogen substituents per molecule. After impregnation with the compositions of the invention the compounds are fixed to the textile material by heating at 100°–150°C.

4 Claims, No Drawings

TEXTILE SOFTENING AGENTS

This is a division, of application Ser. No. 233,343, filed Mar. 9, 1972, now U.S. Pat. No. 3847915.

The present invention relates to a class of new chemical compounds and to a process for softening a textile material by the application of a composition comprising these compounds.

The textile material, usually in the form of yarn or fabric, which can be conditioned by compounds of the present invention consists entirely or partly of fibres having in their molecules free hydroxyl or amino groups or other suitably reactive groups. Preferably, the textile material is composed of fibres of cellulose, regenerated cellulose or a cellulose ester or ether. The compounds of the invention contain two triazine rings, the carbon atoms of each such ring carrying at least one halogen substituent, which can form a covalent bond with the reactive group in the textile material.

Processes for improving textile characteristics which rely upon the formation of this covalent bond are well known. It has, in particular, been proposed to condition textile yarns and fabrics with compounds containing one triazine ring, the carbon atoms of which carry as substituents two halogen atoms and a residue of a primary or secondary amine bound via the nitrogen atom thereof. An excessive waterrepellency is, however, often introduced into the material which has been treated in this way.

The compounds of the present invention, when applied to suitable textile materials, contribute a softening effect which is usefully resistant to washing and which is not accompanied by an excessive water-repellency as found previously.

Accordingly, the present invention provides a compound of the general formula

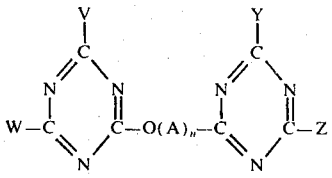

(I)

in which A represents an ethenoxy; propenoxy; 1,2 or 2,3 butenoxy group or a combination thereof, VWYZ represent halogen, -OH, $-NRR_1$ or $-OR_1$ providing that at least one of VW and at least one of YZ is halogen and at least one of VWYZ is $-OR_1$ or $-NRR_1$.

R represents hydrogen or a $C_{12}$-$C_{30}$ linear or branched chain alkyl group, $R_1$ represents a $C_{12}$-$C_{30}$ linear or branched chain alkyl group, n = 1-80.

The term "halogen" in this specification refers to either chlorine or bromine. It will be further understood that the term $-O(A)_n-$ covers a polyethylene glycol, a polypropylene glycol, a polybutylene glycol residue or a copolymer residue containing any combination of ethenoxy, propenoxy or butenoxy units.

Preferred compounds possess the following structures:

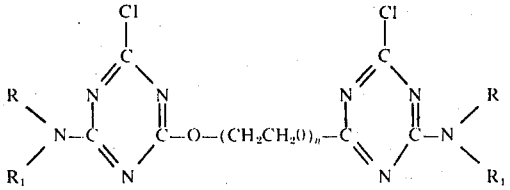

(II)

in which R and $R_1$ represent a $C_{16}$-$C_{22}$ linear or branched chain alkyl group and n is 4-80.

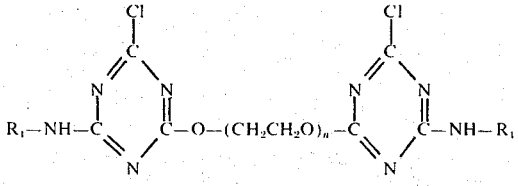

(III)

wherein n = 4-35 and $R_1$ represents a $C_{16}$-$C_{22}$ linear or branched chain alkyl group.

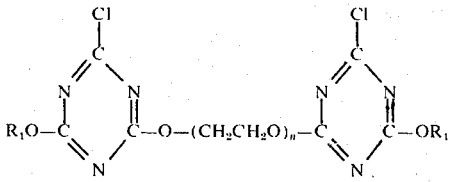

(IV)

wherein n = 4-35 and $R_1$ represents a $C_{16}$-$C_{22}$ linear or branched chain alkyl group.

The compounds of the present invention are prepared with the aid of a $C_2$-$C_4$ alkylene glycol, a poly$C_2$-$C_4$alkylene glycol or a derivative thereof which is introduced directly into each of the two triazine rings. The poly$C_2$-$C_4$alkylene glycol is preferably a polyethylene glycol having a molecular weight ranging from 600–1000 or a copolymer of similar molecular weight containing propylene oxide units together with a majority of ethylene oxide units. The introduction of this intermediate increases the hydrophilic characteristics and reduces the water-repellency characteristics of the reaction product. Furthermore, once the compounds of this invention have been reacted with the free reactive groups in the textile material, the softening effect achieved is resistant to repeated washing. The softening effect of the treated textile material is assessed subjectively by a skilled panel who compare its handle with the handle of a similar untreated textile material and the handle of a further similar textile material which has been treated with a conventional cationic softener.

The above compounds of the present invention differ from previously proposed compounds in having a hydrophilic solubilising group linked to each of the two triazine rings. These compounds also possess an average of two hydrophobic groups and two halogen substituents per molecule. The ratio of hydrophilic to hydrophobic groups can be selected to give to the compounds the property of dispersibility in water and textile softening without excessive water-repellency. In general, the longer the hydrophilic group (the greater the numerical value of n) the greater the water solubility and the less the water repellency. There is an upper limit to the size of the hydrophilic group beyond which softening will diminish. This limit depends on the nature of R and $R_1$ and occurs when n has a value ranging from 40 to 80.

The water-repellency effect is simply determined by placing a droplet of water on the conditioned textile material and noting the time for complete absorption. Preferably this time should not amount to more than 2 or 3 seconds.

The compounds of the present invention are conveniently formed by condensing 2 moles of a cyanuric halide, preferably cyanuric chloride, with 1-1.1 mole of an alkylene glycol, polyalkylene glycol or derivative thereof in the presence of an inert solvent and an acid binding agent. The acid binding agent which neutralises the hydrogen chloride formed during this condensation reaction can be organic (such as pyridine or a tertiary amine base) or inorganic in nature (an alkali metal or alkaline earth metal carbonate, bicarbonate or hydroxide). Condensation conditions are so controlled that substantially only one halogen substituent of the cyanuric halide will react. The reaction product is subsequently further condensed with 2 moles of a suitable amine or alcohol again in the presence of an acid binding agent. If desired, the condensation with the amine or alcohol can be effected as a first stage.

The compounds of the present invention are applied to a textile material (yarn or fabric) in solution form or as a dispersion or emulsion. Water is usually used as a diluent or solvent in forming the composition. Other diluents or solvents which can be used include a chlorinated hydrocarbon such as trichloroethylene. Any member of the conventional ranges of soaps, anionic or non-ionic surfactants can be considered as a suitable dispersing agent or emulsifier for these compounds or their solutions. However, the reactivity of the compounds of the invention with any dispersing agent or emulsifier which contains a primary hydroxyl group should be borne in mind in formulating the compositions for application to the textile material. The dispersions or emulsions may also contain a thickening agent, for example alginic acid or sodium alginate. Other textile finishing agents may also be added to the dispersion or emulsion if required, for example, other softening or lubricating agents, water-repellency agents, antistatic agents, soil release polymers, fungicides or bactericides.

The content of the compounds of the invention in the solutions, dispersions or emulsions used for conditioning textile materials can vary within wide limits. If solutions, dispersions or emulsions are prepared for direct application to textile materials they will contain 0.001 to 25 parts of the compound per 100 parts by weight of solution, dispersion or emulsion. With an aqueous or chlorinated hydrocarbon diluent it is advantageous to prepare solutions or dispersions with a high content of the compound, the solution or dispersion being diluted with water before use. Solutions, dispersions or emulsions requiring dilution can contain 5 to 80 parts of the compound per 100 parts by weight of the total composition.

It is desirable to obtain a pick-up of the compounds of this invention on the textile material of at least 0.05% by weight of the textile material. The optimum effect is achieved at about 0.3%.

The textile material (yarns or fabrics) may be impregnated by an immersion, spraying or coating process. It is preferably impregnated by immersion in the solution, emulsion or dispersion of the invention followed by expression to a controlled pick-up on a pad mangle. Typical pick-up of the solution, emulsion or dispersion varies from about 50-150% by dry weight of the textile material, depending upon the textile material and the equipment used. After impregnation, the textile material, which can be optionally dried, is passed through a bath containing an aqueous solution of an acid binding agent. This bath preferably contains a dilute aqueous solution of sodium- or potassium-carbonate, sodium- or potassium-bicarbonate or sodium- or potassium-hydroxide and has a pH of at least 7.5. The textile material is further impregnated with this solution and dried.

The compounds of the invention are fixed by heating the impregnated textile material to 100°–150°C for a time varying from 30 seconds at 150°C to 10 minutes at 100°C. Alternatively, the acid binding agents may be included in the impregnating bath with the compound of the invention, fixation being brought about by drying and heating in a similar way. The treating bath or the fixing bath may also contain optical bleaching agents or fibre reactive dyestuffs which can be conveniently applied simultaneously with the compounds of this invention.

After fixation the textile material is normally scoured at the boil in a 1-2 g/l non-ionic detergent solution, rinsed and dried.

This invention is further illustrated with reference to the following Examples, in which all parts and percentages are by weight.

EXAMPLE 1

Preparation of alpha, omega -bis(4-distearylamino,6-chlorotriazin-2-yl) polyethylene glycol 600

12.2 g cyanuric chloride (0.066 mole) was dissolved in 50 ml dry acetone and the solution cooled to 5°C in an ice/water bath. 20 g (0.033 mole) polyethylene glycol having an average molecular weight of 600 (referred to henceforth as polyethylene glycol 600) and 8.0 g collidine (0.066 mole) were dissolved in 50 ml dry acetone and the solution added dropwise to the cyanuric chloride solution with stirring over a period of 2 hours.

The temperature was slowly raised to ambient, the precipitate of collidine hydrochloride was filtered off and the acetone solution was evaporated on a rotary evaporator at 30°C. An oily liquid remained (29.0 g, 98% yield) which analysed as: C. 45.5%, H. 6.3%, N. 9.1%, Cl. 14.4%. The desired intermediate alpha, omega -bis(4,6-di-chloro-triazin-2-yl) polyethylene glycol 600 requires: C. 42.6%, H. 5.7%, N. 9.9% and Cl. 16.8%.

4.5 g of the above product (0.005 mole) was dissolved in 20 ml pure dry chloroform. 5.2 g distearylamine (0.01 mole) and 1.2 g collidine (0.01 mole) were dissolved in 20 ml pure dry chloroform and added dropwise with stirring over a period of 30 minutes at 25°C. The reaction mixture was then stirred for 2 hours at 35°–40°C and the chloroform then distilled off under vacuum. 50 ml acetone was added to the residue, the insoluble collidine hydrochloride was filtered off and the acetone subsequently evaporated from the filtrate. The resulting product (8.8 g, 100% yield) analysed as: C. 69.7%, H. 10.4%, N. 6.8%, Cl. 4.7%. Alpha, omega -bis(4-distearylamino,6-chloro-triazine-2-yl) polyethylene glycol 600 requires: C. 67.0%, H. 10.7%, N. 6.4%, Cl. 4.0%.

EXAMPLE 2

37 parts cyanuric chloride was dissolved in 365 parts trichloroethylene. 63 parts polyethylene glycol 600 and 21 parts triethylamine were dissolved in 365 parts dry chloroethylene. The polyethylene glycol solution was added to the stirred solution of cyanuric chloride at such a rate that the temperature of the reaction mixture did not rise above 25°C. After the addition had been completed the reaction mixture was stirred for a further hour and then allowed to stand overnight at ambient temperature.

104 parts distearylamine were added to the reaction mixture together with a solution of 20 parts triethylamine in 730 parts trichloroethylene. The temperature of the reaction mixture was then increased to 55°C and maintained at this temperature with stirring for 3 hours. The reaction mixture was subsequently cooled to ambient temperature and the precipitate of triethylamine hydrochloride was removed by filtration. The reaction product was recovered in 90% yield as a 17% w/v solution in trichloroethylene. This solution could conveniently be dispersed in water and applied to textile materials.

EXAMPLE 3

A compound of the general formula (V)

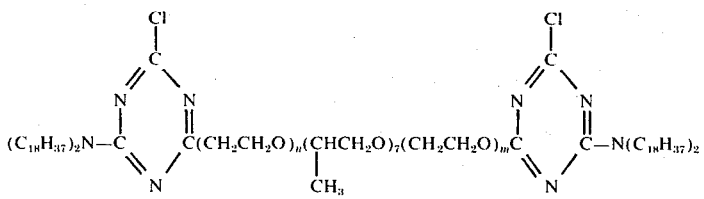

where $(n + m) = 14$ was prepared by the method described in Example 1. 0.066 mole cyanuric chloride was condensed with 0.033 mole of a polypropylene glycol of formula $HO(CHCH_3CH_2O)_7H$ which had been condensed with 14 moles ethylene oxide. The condensation product was subsequently further condensed with 0.066 mole of distearylamine.

The final condensation product could be applied to terry-towelling by the method described in Example 5. The average time taken for water droplets placed on the treated towelling to be completely absorbed was 3 seconds.

EXAMPLE 4

Preparation of alpha, omega -bis(4-tallowyloxy,6-chlorotriazin-2-yl) polyethylene glycol 600

9.0 g alpha, omega -bis(4,6-dichloro-triazin-2-yl) polyethylene glycol 600 (0.01 mole), 5.3 g hardened tallow alcohol (0.02 mole) and 2.4 g collidine (0.02 mole) were heated together on the steam bath for 2 hours. The reaction mixture was cooled to ambient temperature and shaken with 50 ml acetone. The insoluble collidine hydrochloride was filtered off (3.1 g, 100% yield) and the acetone was evaporated. Yield = 13.4 g (98.5%).

Elemental Analysis

Found: C. -62.8%; H. 9.8%; N. 6.2% Cl. 5.5%
Theory: C. 60.3%; H. 9.1%; N. 6.5% Cl. 5.5%.

The following Examples 5–10 show that when fabrics are treated with a compound of the present invention, they have a soft handle which is retained after washing, without yellowing or increased soiling properties, at least over 6 washes. Softness is assessed subjectively by a skilled panel who compare the handle of the treated fabrics with the handle of untreated fabric of the same type and with the handle of fabric of the same type which has been treated with conventional cationic softener.

EXAMPLE 5

A cotton terry-towelling fabric was impregnated with an aqueous dispersion containing 1 part alpha, omega -bis(4-distearylamino,6-chloro-triazin-2yl) polyethylene glycol 600 as prepared in Example 1, 1 part of a dispersing agent 2 parts sodium carbonate and 96 parts water. The sample of towelling was squeezed until it contained about 150% by weight of the dispersion based on the dry weight of fabric and subsequently heated at 100°C for 10 minutes. The heated fabric was then washed at the boil in a solution containing 1 g/liter of a non-ionic detergent and finally rinsed and dried. The average time taken for water droplets placed on the towelling to be completely absorbed was 2 seconds.

EXAMPLE 6

A cotton terry-towelling fabric was treated in an identical manner to that described in Example 5 with a dispersion containing 1 part alpha, omega -bis(4-distearylamino,6-chlorotriazin-2-yl) polyethylene glycol (average mol.wt. 1000), 1 part dispersing agent, 2 parts sodium carbonate and 96 parts water. The heated fabric was subsequently washed, rinsed and dried. The average time taken for water droplets placed on the treated towelling to be completely absorbed was less than 1 second.

EXAMPLE 7

100 parts of a solution prepared as described in Example 2 was dispersed in 900 parts aqueous solution containing 3% sodium carbonate and 0.5% sodium stearate. A sample of cotton towelling fabric was wetted out with this dispersion and passed through a mangle to leave 100% of dispersion on weight of fabric. The impregnated towelling was subsequently dried on a pin frame at 140°C for 5 minutes and washed off at the boil in a solution containing 1 g/liter non-ionic detergent. The treated fabric was subsequently rinsed and dried. The treated fabric had a soft handle which was retained after 15 washes in a "drum-type" domestic washing machine while untreated towels included in the same washes became extremely harsh.

EXAMPLE 8

A cotton terry-towelling fabric was treated by a method as described in Example 5 with alpha, omega -bis(4-tallowloxy,6-chloro-triazin-2-yl) polyethylene glycol 1000 which was prepared by a method as described in Example 4. The average time taken for water droplets placed on the towelling to be completely absorbed was 3 seconds.

EXAMPLE 9

A cotton terry-towelling fabric was treated by a method as described in Example 5 with alpha, omega -bis(4-alkoxy,6-chloro-triazin-2-yl) polyethylene glycol 1000, the alkoxy group being derived from the commercially available linear $C_{20}$-$C_{24}$ alcohols sold under the trade name of Alfol 20+, the average time taken for water droplets placed on the towelling to be completely absorbed was less than 1 second.

EXAMPLE 10

A cotton terry-towelling fabric was treated by a method as described in Example 5 with alpha, omega -bis(4-monostearylamino,6-chloro-triazin-2-yl) polyethylene glycol 600. The average time taken for water droplets placed on the towelling to be completely absorbed was less than 1 second.

In the foregoing Examples 5–10 the cotton terry-towelling may be replaced by natural or regenerated cellulosic yarns or fabrics when a similar durable softness property will be obtained.

What is claimed is:

1. A process for conditioning a textile material composed of fibres selected from the group consisting of cellulose, regenerated cellulose, cellulose ester and cellulose ether fibres comprising a impregnating the textile material with an aqueous composition comprising a compound of the general formula

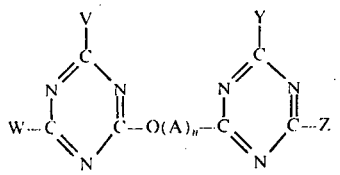

(I)

in which A represents an ethenoxy; propenoxy; 1,2 or 2,3 butenoxy group or a combination thereof, VWYZ represent halogen, -OH, $-NRR_1$ or $-OR_1$ providing that at least one of VW and at least one of YZ is halogen and at least one of VWYZ is $-OR_1$ or $-NRR_1$, R represents hydrogen or a $C_{12}$-$C_{30}$ linear or branched chain alkyl group, $R_1$ represents a $C_{12}$-$C_{30}$ linear or branched chain alkyl group, n=1-80 b treating the impregnated material with an aqueous solution containing an acid binding agent and having a pH of at least 7.5;

c heating the treated textile material at a temperature of 100° to 150°C for a time effective to fix the compound.

2. A process as claimed in claim 1 the aqueous composition additionally contains a chlorinated hydrocarbon.

3. A process for conditioning a textile material as claimed in claim 1, in which the textile material is impregnated with an aqueous composition containing the compound as defined in claim 1 and an acid binding agent and the impregnated textile material is subsequently heated at a temperature of 100° to 150°C for a time effective to fix the compound.

4. A process as claimed in claim 3 in which the aqueous composition additionally contains a chlorinated hydrocarbon.

* * * * *

UNITED STATES PATENT OFFICE

CERTIFICATE OF CORRECTION

Patent No. 3,961,892 Dated June 8, 1976

Inventor(s) David Paul Bishop and Ronald Meredith Morris

It is certified that error appears in the above-identified patent and that said Letters Patent are hereby corrected as shown below:

On title page, [73] Assignee:, change "Lever Brothers Company, New York, N.Y." to --NV Internationale Octrooimaatschappij "Octropa", Rotterdam, Netherlands--.

Signed and Sealed this

Fifth Day of April 1977

[SEAL]

*Attest:*

RUTH C. MASON
*Attesting Officer*

C. MARSHALL DANN
*Commissioner of Patents and Trademarks*